US008585891B2

(12) United States Patent
Lourenco et al.

(10) Patent No.: US 8,585,891 B2
(45) Date of Patent: Nov. 19, 2013

(54) EXTRACTION AND UPGRADING OF BITUMEN FROM OIL SANDS

(76) Inventors: Jose Lourenco, Edmonton (CA); MacKenzie Millar, Edmonton (CA)

( * ) Notice: Subject to any disclaimer, the term of this patent is extended or adjusted under 35 U.S.C. 154(b) by 336 days.

(21) Appl. No.: 12/996,768

(22) PCT Filed: Apr. 7, 2010

(86) PCT No.: PCT/CA2010/000530

§ 371 (c)(1),
(2), (4) Date: Dec. 7, 2010

(87) PCT Pub. No.: WO2010/115283

PCT Pub. Date: Oct. 14, 2010

(65) Prior Publication Data

US 2011/0089084 A1 Apr. 21, 2011

Related U.S. Application Data

(60) Provisional application No. 61/167,371, filed on Apr. 7, 2009.

(51) Int. Cl.
*C10G 1/04* (2006.01)

(52) U.S. Cl.
USPC ..... 208/390; 208/414; 208/391

(58) Field of Classification Search
USPC ..... 208/414, 390
See application file for complete search history.

(56) References Cited

U.S. PATENT DOCUMENTS

| | | | | |
|---|---|---|---|---|
| 4,094,767 | A | | 6/1978 | Gifford, II |
| 4,306,961 | A | | 12/1981 | Taciuk |
| 4,323,446 | A | * | 4/1982 | Chervenak et al. ..... 208/410 |
| 4,459,201 | A | | 7/1984 | Eakman |
| 4,561,966 | A | | 12/1985 | Owen |
| 5,536,488 | A | | 7/1996 | Mansour |

FOREIGN PATENT DOCUMENTS

| | | | |
|---|---|---|---|
| CA | 2 515 999 A1 | | 10/2004 |
| JP | 2006-104261 | * | 4/2006 |
| JP | 2006-104261 A | | 4/2006 |

OTHER PUBLICATIONS

International Search Report mailed Aug. 26, 2010, issued in corresponding International Application No. PCT/CA2010/000530, filed Apr. 7, 2010, 3 pages.

* cited by examiner

*Primary Examiner* — Randy Boyer
*Assistant Examiner* — Juan Valencia
(74) *Attorney, Agent, or Firm* — Christensen O'Connor Johnson Kindness PLLC

(57) ABSTRACT

A method to extract and process bitumen from oil sands involves processing in a pulse enhanced fluidized bed steam reactor, cracking the heavy hydrocarbon fractions, producing hydrogen in situ within the reactor and hydrogenating the cracked fractions using the natural bifunctional catalyst present in the oil sands. This method produces inert oil sands for soil rehabilitation and an upgraded oil stream.

7 Claims, 2 Drawing Sheets

EXTRACTION AND UPGRADING OF BITUMEN FROM OIL SANDS

FIELD OF THE INVENTION

The present invention relates to a method of simultaneously extracting and upgrading bitumen from oil sands, first by heating and vaporizing the lower boiling point fractions and secondly by vaporizing and cracking the heavier hydrocarbon fractions in a pulsed enhanced fluidised bed steam reactor to produce an upgraded oil.

BACKGROUND OF THE INVENTION

The oil sands in Northern Alberta are one of the largest hydrocarbon deposits in the world. The oil sands are bitumen mixed with water and sand, of which 75-80% is inorganic material (sand, clay and minerals), 3-5% water with bitumen content ranging from 10-18%. Each oil sand grain has three layers: an envelope of water surrounds the grain of sand and a film of bitumen surrounds the water. Located in north eastern Alberta, the oil sands are exploited by both open pit mining and in situ methodologies. The open pit mining uses a shovel/truck combination for bitumen deposits that are close to the surface. The in situ methods use cycle steam simulation and steam assisted gravity drainage for bitumen deposits that are too deep for economical mining. The present practice of bitumen extraction from the mined oil sands uses large amounts of hot water and caustic soda to form a oil sands ore-water slurry, this slurry is processed to separate it into three streams; bitumen, water and solids. The water consumed in this process is high, at a ratio of 9 barrels of water per 1 barrel of oil. The bitumen recovered by the current extraction methods of open pit mining is about 91% by weight, the balance of the bitumen remains in both; solids and water streams, making these toxic and with a need for containment. The tailings ponds created in Northern Alberta from oil sands operations are vast and considered by many an ecological disaster. More recently, major breakthroughs in extracting bitumen from oil sands are claimed by oil sands operators, these reduce the temperature of the water from 80 C to 60 C while maintaining and even improving bitumen recovery rates, resulting in a 75% energy savings to heat the water.

The extracted bitumen from the oil sands contain wide boiling range materials from naphthas to kerosene, gas oil, pitch, etc., and which contain a large portion of material boiling above 524 C. This bitumen contains nitrogenous and sulphurous compounds in large quantities. Moreover, they contain organo-metallic contaminants which are detrimental to catalytic processes, nickel and vanadium being the most common. A typical Athabasca bitumen may contain 51.5 wt % material boiling above 524 C, 4.48 wt % sulphur, 0.43 wt % nitrogen, 213 ppm vanadium and 67 ppm nickel. Technologies for upgrading bitumen into lighter fractions can be divided into two types of processes: carbon rejection processes and hydrogen addition processes. Both of these processes employ high temperatures to crack the long chains. In the carbon rejection process, the bitumen is converted to lighter oils and coke. Examples of coking processes are fluid bed cokers and delayed bed cokers, they typically remove more than 20% of the material as coke, this represents an excessive waste of resources. In hydrogen addition processes, and in the presence of catalysts an external source of hydrogen (typically generated from natural gas) is added to increase the hydrogen to carbon ratio, to reduce sulphur and nitrogen content and prevent the formation of coke. Examples of hydrogen addition processes include: catalytic hydroconversion using HDS catalysts; fixed bed catalytic hydroconversion; ebullated catalytic bed hydroconversion and thermal slurry hydroconversion. These processes differ from each from: operating conditions, liquid yields, catalysts compositions, reactor designs, heat transfer, mass transfer, etc., the objective being to decrease the molecular weight of large fractions to produce lighter fractions and remove sulphur and nitrogen. A process for thermal and catalytic rearrangement of shale oils is described by Eakman et al. in U.S. Pat. No. 4,459,201. The disclosed process uses two vessels, a reactor and a combustor where the sand is circulated as the heating medium. A method to process oil sands described by Gifford et al. in U.S. Pat. No. 4,094,767, describes a process to produce hot coked sand and oil. Another process for direct coking of oil sands was described by Owen et al. in U.S. Pat. No. 4,561,966, where the oil sands are introduced into a fluid coking vessel which has at least two coking zones. This process receives its heat source from a circulating stream of hot sand between the combustor and the fluid coking vessel. A thermal process described by Taciuk in U.S. Pat. No. 4,306,961, described a process to recover and upgrade bitumen from oil sands in a rotating kiln processor. A process of an indirectly heated thermochemical reactor processes is described by Mansour et al. in U.S. Pat. No. 5,536,488, where the use of pulse enhanced combustors immersed in a fluidized bed are employed. The described process promotes the use of catalysts for steam reforming and production of syngas.

SUMMARY OF THE INVENTION

About 2 tons of oil sand are required to produce 1 barrel of oil, the key challenges currently facing oil sands producers are; the supply of fresh water required for extraction, the subsequent containment of this generated toxic water and the supply of natural gas required for the process. The typical recovery of bitumen from the oil sands and processing to synthetic crude is approximately 68%. The losses in the extraction of bitumen from the oil sands are about 9% and from the upgrading coke processes are about 23%, mainly converted to coke, presently land filled at site.

The present invention eliminates the current practice of using large volumes of hot water and caustic soda to scrub the bitumen from the sands, substantially reduce the consumption of natural gas, increase the recovery of bitumen and upgrade it for pipeline transport.

According to the present invention there is provided a method to of recovering and upgrading bitumen from oil sands. This involves feeding oil sands through an inlet at the top of a pulsed enhanced steam reforming reactor. The reactor has at least two sections, a vaporization and cracking section and a steam reforming section. The steam reforming section includes a fluidised bed heated by at least one pulse enhanced combustor heat exchanger immersed in the fluidised bed. The vaporization and cracking section is vertically spaced from the steam reforming section. The inlet for the oil sands is positioned in the vaporization and cracking section with the vaporization and cracking section being in communication with the steam reforming section such that the oil sands passes through the vaporization section to reach the steam reforming section. The vaporization and cracking section is maintained at a vaporization and cracking temperature that is less than a steam reforming temperature maintained in the steam reforming section to provide an opportunity for vaporization of lighter hydrocarbon fractions and cracking of heavier hydrocarbon fractions prior to entering the steam reforming section. An outlet is provided for vaporized hydrocarbon fractions. At least one heat exchanger for temperature control purposes is positioned in the vaporization and cracking section. A temperature gradient within the vaporization and cracking section of the reactor is controlled by selectively controlling the rate of flow of coolant through the heat exchanger to remove excess heat from the vaporization and cracking section. Temperature in the steam reforming section is controlled by selectively controlling fuel gas flow to a specific burner or burners. Hydrogen is produced in situ within the steam reforming section of the reactor by indirect heating steam reforming and water-gas shift reactions and the natural bifunctional catalyst present in the oil sands is used to promote hydrogenation. The hydrogen generation rate is controlled by controlling temperature in the cracking section and steam flow rates.

BRIEF DESCRIPTION OF THE DRAWING

These and other features of the invention will become more apparent from the following description in which reference is made to the appended drawing, the drawing is for the purpose of illustration only and is not intended to in any way limit the scope of the invention to the particular embodiment or embodiments shown, wherein.

DETAILED DESCRIPTION OF THE PREFERRED EMBODIMENT

Figure 1:
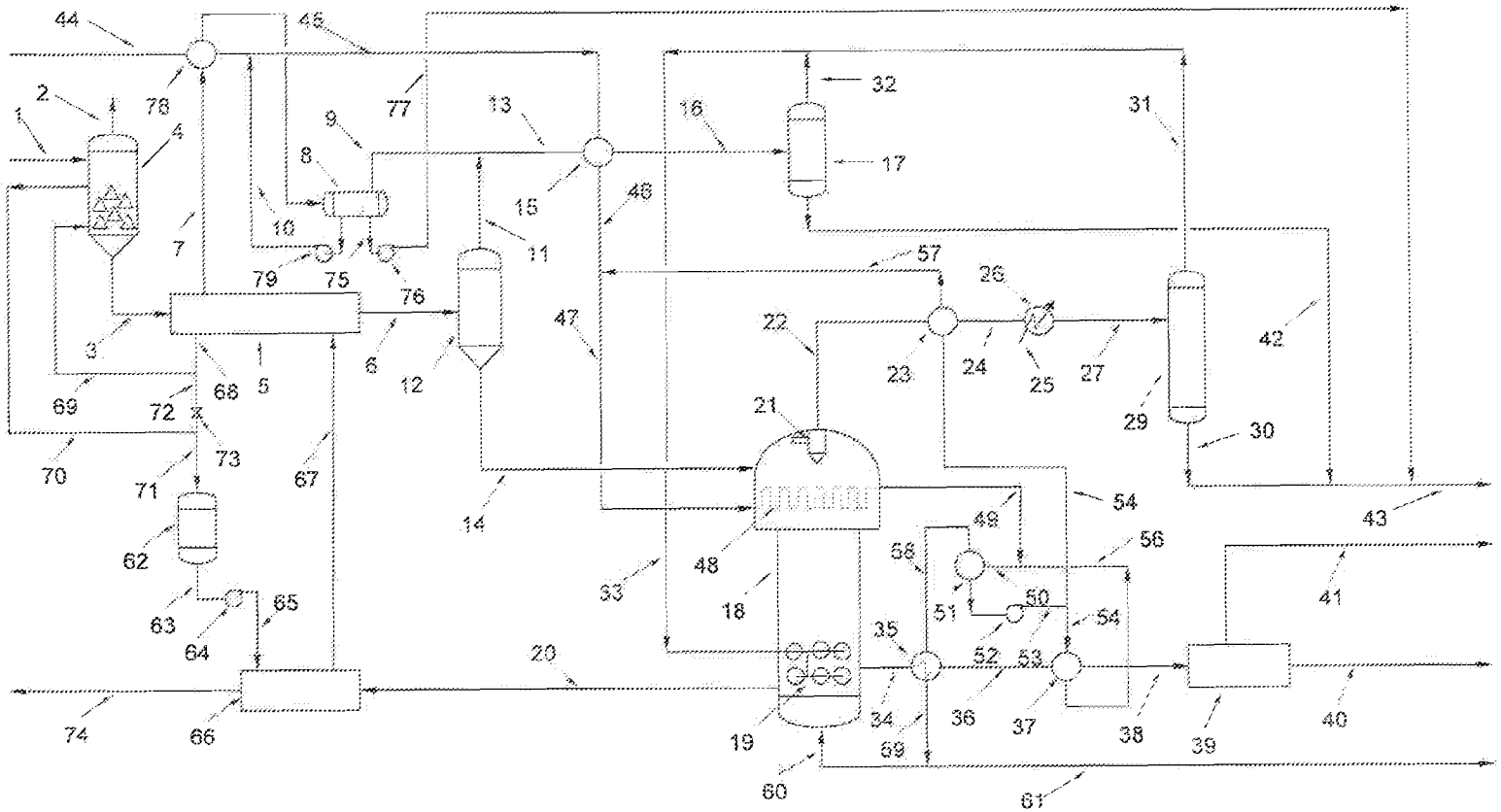
FIG. 1 is a flow diagram illustrating a method for processing oil sands by extracting bitumen from the oil sands, upgrade the bitumen by; using the natural bifunctional catalyst in the oil sands, generating hydrogen to meet upgrading needs from the coke fraction and produce an inert solids fraction.

In this process, the oil sands are first classified and screened to 3" size or less, heated to 60 C and oxygen free in a pretreatment vessel. It is then fed to a low pressure heated screw conveyor and heated to a target temperature of between 150 C and 350 C. Beneficial results have been obtained at 300 C. The vaporized water and hydrocarbon fractions exit the heated screw, are cooled and separated into three streams; water, liquid hydrocarbons and gases. The heated oil sands are discharged into a low pressure vessel at the controlled temperature, up to 300 C, and separated into gases and oil slurry. The gases are cooled and separated into a fuel gas stream and a liquid product stream. The gases are used as a fuel source in the process and the liquid product goes to tankage. The oil slurry, the high boiling point oil fractions and sand, is fed to the top of the pulsed enhanced fluidized bed steam reactor where the temperature is controlled at 400 C. The temperature at the top the pulse enhanced steam reactor is controlled by generating steam. The oil fractions in the slurry with a boiling point of 400 C or less are quickly vaporized before cracking occurs. The oil fractions in the sand with a boiling point greater than 400 C cascades down the pulse enhanced steam reactor picking up convective heat in a countercurrent flow with the vapor fractions and hydrogen generated in the fluidized pulsed enhancer steam reformer. The oil sands solids composition include, clays, fine sand and metals such as nickel which promote catalytic activity to produce hydrogen, $H_2S$ and lighter fractions. As the oil sand slurry travels from the top of the bed downwards and gaining temperature, the oil in the slurry vaporizes and cracks accordingly. As the heavier fractions in the oil slurry enter the pulse enhanced deep steam fluidized bed section, pyrolisis occurs, volatile components are released and the resulting coke will undergo steam reforming to produce hydrogen. The deep steam reactor fluidized bed covers the pulse enhanced combustor heat exchangers containing a large mass of solids media from the oil sands providing a large thermal storage for the process. This attribute makes it insensitive to fluctuations in feed rate allowing for very high turn down ratios. The endothermic heat load for the steam reforming reaction is relatively large and the ability to deliver this indirectly in an efficient manner lies in the use of pulse enhanced combustor heat exchangers which provide a very high heat transfer. The deep sand bed is fluidized by superheated steam and indirectly heated by immersed pulsed enhanced combustors. The coke is combined with the superheated steam to generate hydrogen and carbon monoxide at temperatures in a range of 700 C to 900 C. Beneficial results have been obtained at 815 C. Steam reformation is a specific chemical reaction whereby steam reacts with organic carbon to yield carbon monoxide and hydrogen. In the pulse enhanced steam reformer the main reaction is enthothermic as follows: $H_2O+C+heat=H_2+CO$, $heat=H_2+CO$, steam also reacts with carbon monoxide to produce carbon dioxide and more hydrogen through the water gas shift reaction: $CO+H_2O=H_2+CO_2$. The pulse enhanced fluidized bed steam reactor is able to react quickly to temperature needs because the pulsed enhanced combustion heat exchangers are fully immersed in the fluidized bed and have a superior heat mass transfer. The pulsed heat combustor exchangers consist of bundles of pulsed heater resonance tubes. The gas supply required for the pulse heat combustor exchangers is provided by the sour fuel gas generated in the process, making the steam reactor energy sufficient by operating on its own generated fuel. Simultaneously, the high temperature generated in the pulse heat combustor converts the $H_2S$ in the sour gas into elemental sulfur and hydrogen. Pulsations in the resonance tubes produce a gas side heat transfer coefficient which is several times greater than conventional fired-tube heaters, providing both mixing and a superior heat mass transfer. The pulse enhanced combustor heat exchangers operate on the Helmholtz Resonator principle, sour fuel gas is introduced into the combustion chamber with air flow control through aerovalves, and ignite with a pilot flame; combustion of the air-sour fuel gas mix causes expansion. The hot gases rush down the resonance tubes, leaving a vacuum in the combustion chamber, but also causes the hot gases to reverse direction and flow back towards the chamber; the hot chamber breaching and compression caused by the reversing hot gases ignite the fresh air-sour fuel gas mix, again causing expansion, with the hot gases rushing down the resonance tubes, leaving a vacuum in the combustion chamber. This process is repeated over and over at the design frequency of 60 Hz or 60 times per second. This rapid mixing and high temperature combustion in the pulse enhanced combustor heat exchanger provide the ideal conditions for the conversion of the $H_2S$ in the sour fuel gas stream to $H_2$ and $S_2$. Only the tube bundle portion of the pulse enhanced combustor heat exchanger is exposed to the steam reactor process. Because the bundles are fully immersed in a fluid bed, the heat transfer on the outside of the tubes is very high. The resistance to heat transfer is on the inside of the tubes. However, since the hot flue gases are constantly changing direction (60 times per second), the boundary layer on the inside of the tube is continuously scrubbed away, leading to a significantly higher inside tube heat transfer coefficient as compared to a conventional fire-tube. The hydrogen generated is consumed in the saturation of the cracked fractions and hydrogenation reactions. The produced sour fuel gas is used as fuel in the pulsed enhanced combustor heat exchangers.

Referring to FIG. 1, oil sands with a typical composition 80-85% sand, 3-5% water and 10-15% bitumen is first crushed and classified to a 3 inches minus size and fed by stream 1 into pre-heater vessel 4. The oil sands are heated by a hot oil circulating stream loop up to 60 degrees C. to free the oxygen in the oil sands and route it to the flare system through line 2. The temperature controlled circulating hot oil stream loop provides the heat energy required through inlet line 69 and outlet line 70. The heated oil sands exit vessel 4 through line 3 into a low pressure heated screw conveyor 5. The oil sands are heated up to 300 degrees C. in screw conveyor 5 by a circulating hot oil stream loop supplied through inlet line 69 and outlet line 70. The vaporized hydrocarbon fractions and water exit the heated screw conveyor through line 7 and cooled in heat exchanger 78 before entering vessel 8. The separated water fraction is pumped by pump 79 through line 10 into the boiler feed water supply line. The hydrocarbon liquid fraction is fed to pump 76 through line 75 and pumped through line 77 into product storage. The gaseous stream 9 is mixed with stream 11 this mixture primarily hydrocarbons is cooled in heat exchanger 15 and flows through stream 16 into a gas/liquid separator 17. The liquid hydrocarbon fraction is pumped through line 42 into product storage. The heated oil slurry of hydrocarbons and sand exit screw heater 5 through line 6 at temperatures up to 300° C. into gas/oil slurry separator 12. The gaseous hydrocarbon stream 11 exits separator 12 and mixes with stream 9 for cooling and recovery of hydrocarbon liquids. The bottoms of separator 12 are an oil slurry made up of oil fractions with a boiling point greater than 300 degrees C., clay, sand and fines. The oil slurry is fed through line 14 at the top of a pulsed enhanced steam reformer 18. The top of the steam reformer is temperature controlled up to 400 degrees C. and 25 psig. The objective being to vaporize the lower boiling point fractions in the oil slurry and minimize cracking. The temperature is controlled by generating steam through steam coils 48. As the oil slurry cascades down the steam reformer 18 in a countercurrent with the vapors produced in the steam reformer, it picks up heat creating a temperature gradient from the top of the steam reformer to the bottom. This temperature gradient promotes the vaporization of higher boiling point fractions and reduces cracking. When the oil slurry of heavy fractions and sand enters the superheated steam fluidized bed, pyrolisis will rapidly occur vaporizing and cracking the hydrocarbon fractions with higher boiling points and the resulting coke will undergo steam reforming. The vaporized and cracked hydrocarbons exit the steam reformer reactor in a gaseous phase through cyclone 21 and through line 22 and cooled in heat exchanger 23 through line 24 and trim cooler 26 before entering gas/liquid separator 29 through line 27. The sour gas exits the separator through line 31 to the fuel gas system line 33. The liquid product exits the separator through line to product storage. The oil stripped sands exit the pulse enhanced fluidized steam reactor 18 via stream 20 and gives up its thermal heat in a cooling screw heat exchanger 66. The cooled sand stream 74 exits the plant for soil rehabilitation. The thermal heat recovered in cooling screw heat exchanger 66 is through a thermal oil circulating loop. The thermal oil is supplied from vessel 62 and fed through line 63 into pump 64. The thermal oil flow 65 to screw heat exchanger 66 recovers heat from the oil stripped sands stream 20. The heated thermal oil stream 67 enters oil sands screw conveyor 5 where it pre-heats oil sands stream 3. The cooler thermal oil stream 68 exits screw conveyor 5 and splits into streams 69 and 72. Thermal oil stream 69 is routed to pre-heater vessel 4 to remove entrapped air from the oil sands, and it exits vessel 4 through line 70 where it joins by-pass line 71, returning to thermal oil supply vessel 62 for re-circulation and re-heating. Thermal oil stream line 72 is a temperature control by-pass line, where valve 73 controls the by-pass flow rate of thermal oil to vessel 4. A boiler feed water stream 44 is pre-heated at exchanger 78 by the overhead gases of stream 7, through line 45 into a secondary heat exchanger 15, through line 46, mixed with recycling stream 57, through line 47 into steam coil generator 48, through line 49 and 50 to steam drum 51. At steam drum 51, the saturated steam exits through line 58 through heat exchanger 35 where it is superheated. The superheated steam exits through line 59 to provide fluidization steam to the steam reformer and for hydrogen generation. The excess steam exits through line 61 to a steam header. A circulating boiler feed water stream from steam drum 51 is pumped by circulating pump 52 through line 50 to heat exchangers 37 and 23 through line 54 and returning to steam drum 51 through lines 56 and 57. The overhead sour fuel gas stream 31 from separator 29 is mixed with fuel gas stream 32 from separator 17 and fed sour fuel gas header line 33. The sour fuel gas from line 33 provides the fuel for combustion in pulsed enhanced combustor heat exchangers 19. At very high temperatures, the $H_2S$ in the sour fuel gas is converted into to elemental sulfur and hydrogen. The flue gases containing $S_2$ from pulse enhanced combustor heat exchangers 19 exit the pulse enhanced combustor fluidized bed steam reactor 18 via stream 34 to superheater 35, through line 36 into heat recovery steam generator 37 and through line 38 to sulfur recovery unit 39. The flue gases are released to a stack through line 41 and the liquid sulfur recovered into a pit through line 40.

Figure 2:
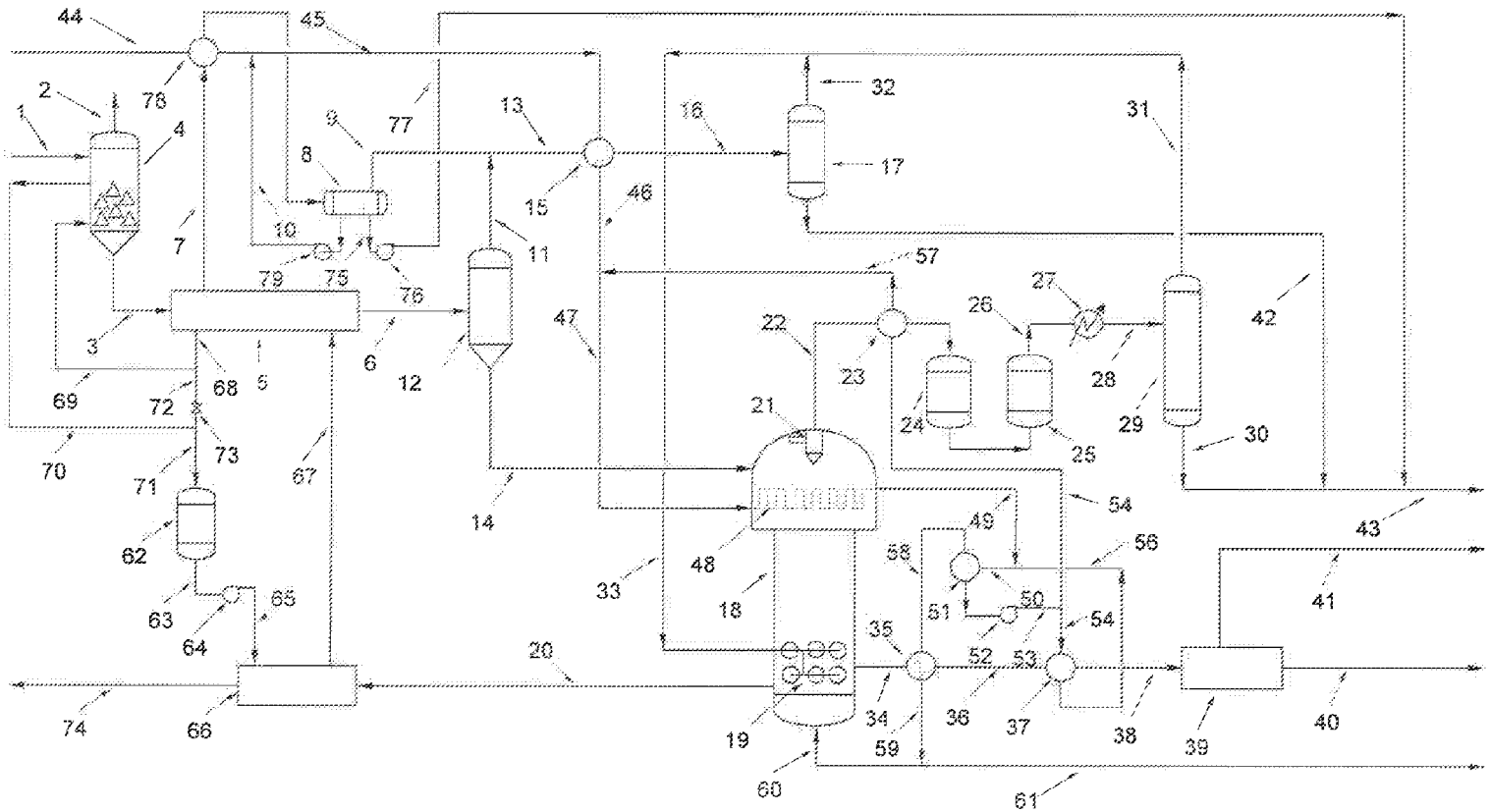
FIG. 2 is a flow diagram illustrating a variation in the process to provide further upgrading in an external catalytic reactor.

Referring to FIG. 2, provides an option to further upgrade the produced oil by adding a guard reactor and a catalytic reactor down stream of heat exchanger 23. The cracked vapor fractions and excess hydrogen generated exit the steam reactor through line 22, and condensed through heat exchanger 23 before entering guard reactor 24 to capture fines present in the stream. The cleaned hydrocarbon stream together with the excess hydrogen enters catalytic reactor 25 where in the presence of a standard nickel/moly catalyst further upgrades the cracked fractions into a stable desulfurized product. The hydrogenated oil exits the catalytic reactor through line 26, through cooler 27 and through line 28 into gas/oil separator 29.

The above described method utilizes the natural bifunctional catalyst in the oil sands to produce hydrogen and upgrade the bitumen, making it catalytic self sufficient. It converts the heavy fractions into light fractions, reducing sulphur and nitrogen, using the sand, clays and minerals in the oil sands as the catalyst. Hydrogen is generated in-situ through steam reforming and the water gas shift reaction to desulfurize and prevent polymerization producing light condensable hydrocarbons. A sour gas stream is combusted in a pulsed enhanced combustor at high temperatures to promote $H_2S$ conversion to $H_2$ and $S_2$. Moreover, the heat generated in the pulsed enhanced combustor provides the indirect heat requirements for the reactor endothermic cracking reactions. Clay, sand, sand fines and the organo-metals present in the oil sands act as a bifunctional catalyst to upgrade the bitumen in the oil sands. According to organic chemistry, at high temperature clay minerals act as a strong acid and this catalytic mechanism accelerates the aquathermolysis of bitumen and reduces the viscosity and average molecular weight of the bitumen. A solids stream of clays and sand is produced from the oil sands that are inert and can be used as; materials of construction, soils conditioners and or soil re-habilitation. Overall the method recovers and processes bitumen in the oil sands, produces sulphur, produces hydrogen, produces an inert solids stream and substantially reduces the environmental impact when compared to existing oil sands processing practices.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of recovering and upgrading bitumen from oil sands, comprising:

preheating oil sands to a target temperature of not less than 150 degrees C. and not more than 350 degrees C. in order to vaporize water and hydrocarbon fractions having a boiling point that is less than the target temperature in the oil sands;

feeding dewatered oil sands with residual hydrocarbon fractions having a boiling point that is greater than the target temperature through an inlet at the top of a pulsed enhanced steam reforming reactor, the reactor having at least two sections, a vaporization and cracking section and a steam reforming section, the steam reforming section including a fluidised bed heated by at least one pulse enhanced combustor heat exchanger immersed in the fluidised bed, the vaporization and cracking section is vertically spaced from the steam reforming section, the inlet for the oil sands being positioned in the vaporization and cracking section, the vaporization and cracking section being in communication with the steam reforming section such that the oil sands passes through the vaporization section to reach the steam reforming section, the vaporization and cracking section being maintained at a vaporization and cracking temperature that is less than a steam reforming temperature maintained in the steam reforming section to provide an opportunity for vaporization of lighter hydrocarbon fractions and cracking of heavier hydrocarbon fractions prior to entering the steam reforming section, an outlet being provided for vaporized hydrocarbon fractions, at least one heat exchanger for temperature control purposes is positioned in the vaporization and cracking section;

controlling a temperature gradient within the vaporization and cracking section of the reactor by selectively controlling the rate of flow of coolant through the heat exchanger to remove excess heat from the vaporization and cracking section;

controlling temperature in the steam reforming section by selectively controlling fuel gas flow to a specific burner or burners; and producing hydrogen in situ within the steam reforming section of the reactor by indirect heating steam reforming and water-gas shift reactions and using the natural bifunctional catalyst present in the oil sands to assist in hydrogenation; and controlling hydrogen generation rate by controlling temperature in the cracking section and steam flow rates.

2. The method of claim 1, wherein the top of the steam reforming reactor is not less than 350 degrees C. and not more than 500 degrees C.

3. The method of claim 1, wherein the steam reforming section of the reactor is maintained at a temperature of about 700 to 900 degrees C.

4. The method of claim 1, wherein the temperature in the vaporization and cracking section is about 350 to 500 degrees C.

5. The method of claim 1, wherein the reactor pressure is a pressure vessel maintained at a pressure of around 25 psig.

6. The method of claim 1, wherein the fuel gas contains hydrogen sulfide gas and is combusted at temperatures up to 1650 degrees C. in a pulsed enhanced combustor reducing it to elemental sulphur.

7. The method of claim 1, further comprising separating vaporized water from the vaporized hydrocarbon fractions and using the water in the steam reforming section.

* * * * *